United States Patent [19]

Malamoud

[11] Patent Number: 4,474,487

[45] Date of Patent: Oct. 2, 1984

[54] PEN POINT WITH LIPS EXTENDING OVER SLIT

[75] Inventor: Jean G. Malamoud, Saint Jorioz, France

[73] Assignee: S. T. Dupont, Paris, France

[21] Appl. No.: 362,184

[22] Filed: Mar. 26, 1982

[30] Foreign Application Priority Data

Apr. 10, 1981 [FR] France ..... 81 07227

[51] Int. Cl.[3] ..... B43K 1/00; B43K 1/02

[52] U.S. Cl. ..... 401/231; 401/221; 401/232; 401/235; 401/236

[58] Field of Search ..... 401/221, 222, 231, 232, 401/251, 235, 236; 15/445, 446, 447

[56] References Cited

U.S. PATENT DOCUMENTS

| | | | |
|---|---|---|---|
| 1,613,812 | 1/1927 | Wahl . | |
| 1,869,950 | 8/1932 | Waldron | 15/446 |
| 2,039,326 | 5/1936 | Lukens | 15/446 |
| 3,303,826 | 2/1967 | Cowden et al. | 15/446 |

FOREIGN PATENT DOCUMENTS

| | | | |
|---|---|---|---|
| 18121 | 8/1881 | Fed. Rep. of Germany . | |
| 801196 | 10/1948 | Fed. Rep. of Germany . | |
| 12663 | 4/1910 | France . | |
| 416213 | 4/1910 | France . | |
| 882267 | 5/1942 | France . | |
| 983957 | 2/1951 | France . | |
| 1040173 | 7/1951 | France . | |
| 54-36830 | 3/1979 | Japan | 401/222 |
| 423545 | 6/1965 | Switzerland . | |
| 2804 | of 1886 | United Kingdom | 401/221 |
| 597219 | 1/1948 | United Kingdom . | |

*Primary Examiner*—Steven A. Bratlie

*Attorney, Agent, or Firm*—Robert A. Shack

[57] ABSTRACT

A pen point for writing with an ink, having a pen nib with two nib points separated by a slit. The surfaces of the nib points perpendicular to the slit have, over a part of their length, a film chemically inert to the ink and wettable thereby, thus forming two lips which substantially cover the slit and abut with one another when the nib is in an unflexed state. The lips extend substantially from the slit origin to the nib tips and consist of a varnish, a plastic material or a metal. The pen point is manufactured by a process wherein a pen nib having two nib points and a slit therebetween is coated with a continuous film of material, chemically inert to the ink and wettable thereby, with the film then being divided to form the two lips.

12 Claims, 6 Drawing Figures

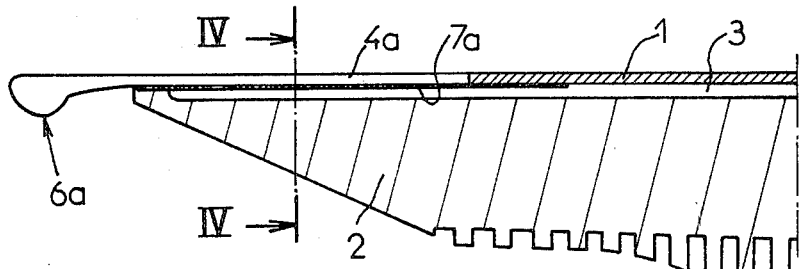
Fig. 1
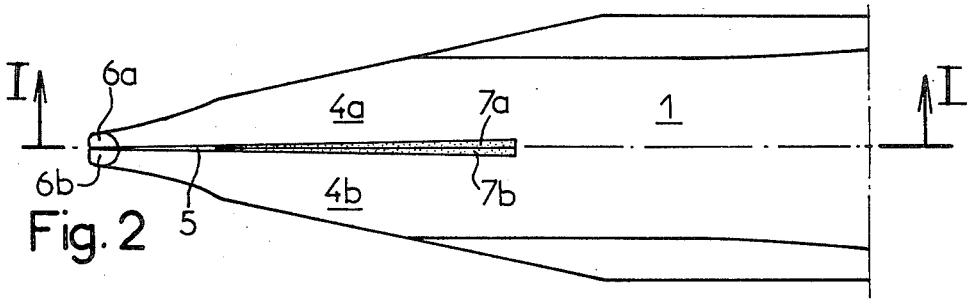
Fig. 2
Fig. 3
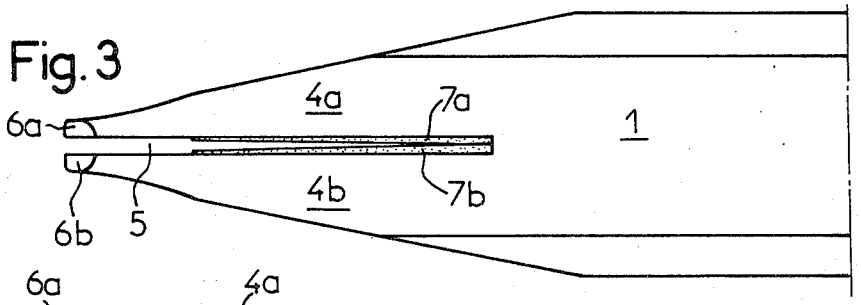
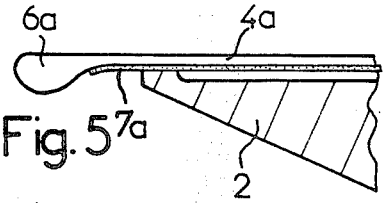
Fig. 5
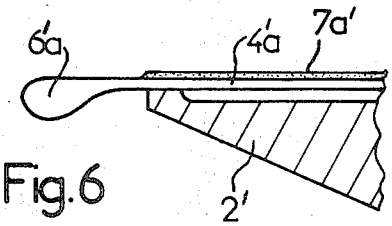
Fig. 6
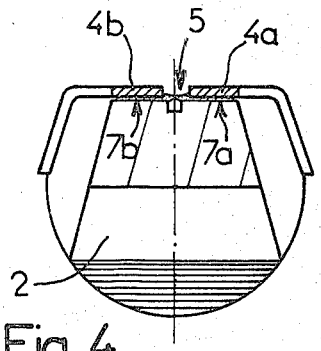
Fig. 4

PEN POINT WITH LIPS EXTENDING OVER SLIT

BACKGROUND OF THE INVENTION

1. Field of the Invention

The present invention concerns a writing device for a fountain pen.

2. Description of the Prior Art

Fountain pens have at one end two points separated by a slit. This slit has two functions: it confers the desired flexibility on the pen and it provides the writing nib with ink. For this purpose, the pen is applied to a feed unit which has several channels connected to the ink reservoir, disposed opposite the pen slit.

This slit is generally formed by cutting the nib with the aid, for example, of a grinding wheel or some other device of this type, after which the points of the writing nib are brought into contact with each other. Although the grinding wheels used in this technology are particularly fine, it is not possible, for mechanical reasons, to decrease the thickness of the wheels below a certain point which corresponds to a minimum slit width.

If this slit were too wide, there would be a serious drawback when the fountain pen was subjected to a shock or sudden jolt since the nib would be caused to vibrate by this jolt and would strike the film of ink brought from the reservoir by the feed channels. The ink would thus be driven out of the nib slit, causing numerous splashes on the external surface of the nib.

To reduce the width of the nib slit and thus reduce this disadvantage, one could make this slit by cutting the nib with shears, but this technique has the disadvantage of subjecting the nib to excessive distortion.

SUMMARY OF THE INVENTION

The goal of the present invention is to propose a writing device for a fountain pen wherein the nib proper comprises a slit of conventional dimensions, which can thus be made by known techniques, but which is provided with a simple and inexpensive means of preventing spattering of the ink when the fountain pen is subjected to a shock or sudden jolt.

For this purpose, the subject of the invention is a writing device for a fountain pen, comprising an ink feed and a nib with two points, these two points being separated by a slit, with the ink supply to the nib being provided by at least one channel from the feed, communicating with an ink reservoir on the one hand, and with said slit on the other hand, said device being characterized by the internal and/or external surfaces of the two points of the nib having on one part of their length a film of a material compatible with ink and wettable thereby and forming two lips, these lips extending under and/or over the slit and joining together in the resting position of the pen.

In fact, Applicant has established that a nib thus equipped on each of its points with a film, said films forming, at right angles to the slit, two lips covering the slit in the resting position, prevents accidental splashing from the free surface of the nib when the fountain pen is subjected to a shock, without thereby posing an obstacle to the normal ink feed to the nib.

Said films can be disposed both on the external surface of the nib and on the internal surface, between the latter and the feed channel.

Advantageously, in order to facilitate ink feed to the nib, the lips extend up to the writing nib of the pen.

They can be made of any material compatible with ink and capable of being wetted thereby, possibly after surface treatment.

It is possible, for example, to use liquid varnishes, in which the points of the nib are dipped and which adhere to the latter when drying. In particular, we could mention varnish based on cellulose acetate or acetobutyrate.

In addition, plastics can be used, especially of the ABS type (acrylonitrile-butadiene-styrene copolymers) or of the polytetrafluorethylene type, whose surfaces can be treated to increase their wettability.

In this way, a metal film can be deposited on the points, in particular gold, with the deposited metal being either identical or not identical to the metal of the nib.

The thickness of the film covering the points of the nib is not critical. It is generally on the order of several hundredths to several tenths of a millimeter.

The film can be deposited on each of the points continuously, completely covering the slit of the nib, the resultant film then being cut off at right angles to the slit either by tearing, simply spreading the points of the nib, or by using means known in technology, such as a laser beam, etc., such as to form two lips which join in the resting position. Such a manufacturing process also enters into the scope of the present invention. Finally, the nibs which form part of the writing device described hereinabove constitute another object of the invention.

BRIEF DESCRIPTION OF THE DRAWINGS

The attached drawings, which are not limitative in nature, illustrate the implementation of the invention.

In these drawings:

FIG. 1 is a lengthwise section through the end of a writing device according to the invention, along line 1—1 in FIG. 2.

FIG. 2 is a top view of the end of the writing device in FIG. 1, with the nib in the resting position.

FIG. 3 is a view similar to that in FIG. 2, with the two points of the nib spread apart.

FIG. 4 is a cross section through the same device, along line IV—IV in FIG. 1.

FIG. 5 is a detailed section of a variant of the device shown in FIG. 1.

FIG. 6 is a section similar to that in FIG. 5, of another embodiment of the invention.

DESCRIPTION OF THE PREFERRED EMBODIMENT

The writing device shown in FIGS. 1–4 comprises, in a manner known of itself, a nib 1 supported by an ink feed 2, comprising a feed channel 3, said channel communicating with an ink reservoir, not shown, and having a free surface facing the lower surface of nib 1.

Nib 1 comprises two points *4a, 4b* separated by a slit 5 and terminating in a writing point *6a, 6b*. In the resting position (FIG. 2), the two points *6a, 6b* are essentially in contact with each other and can spread when the nib is applied to the paper in the writing position (FIG. 3, in which the spread of the points has been exaggerated for the sake of clarity).

When the fountain pen equipped with this writing device receives a shock, nib 1 begins vibrating and knocks repeatedly against the ink contained in channel 2, and splashes the latter through slit 5 with the effect of spattering the external surface of the nib.

To overcome this disadvantage, according to the invention, points 4*a* and 4*b* of the nib are coated, on one of their surfaces (the internal surface in the case of FIGS. 1 to 5) with a film which forms two lips 7*a* and 7*b*, respectively, of a material compatible with the ink, namely chemically inert thereto, and wettable thereby. These films extend over at least a part of the length of the points and are in mutual contact over this entire length, thus covering slit 5, as can be seen, for example, in FIGS. 2 and 4.

In this fashion, lips 7*a* and 7*b* which cover slit 5 in the resting position prevent ink from spattering therethrough, without thereby opposing the ink fed to the nib, in particular to writing points 6*a* and 6*b*.

On the contrary, lips 7*a*, 7*b* can aid in ink feed when points 6*a* and 6*b* are spread apart, as the nib is pressed against the paper (FIG. 3). While this spread normally results in the ink film retreating and no longer coming in contact with points 6*a* and 6*b*, it is sufficient, to overcome this disadvantage, to extend lips 7*a*, 7*b* up to the end of the nib (see FIG. 5, where the elements just described have the same numbers) to minimize their spread and thus favor accessibility of points 6*a* and 6*b* to the ink film.

It is clear that lips 7*a* or 7*b* can be disposed either on the internal or on the external surface of the nib (see FIG. 6, wherein the elements described all have the same numbers, but primed), all performing the same functions.

Thus, the invention provides an easy and simple means of resisting ink spattering under the influence of a shock, through the slit in a fountain pen nib, thus preventing the spotting of the external surface of the nib which normally results.

Although the present invention has been described by way of reference to a particular detailed embodiment, those skilled in the art will recognize that various substitutions of equivalents may be effected without departing from the spirit and scope of the invention as set forth in the following claims.

What is claimed is:

1. A pen point for writing with an ink, comprising:

a pen nib having two nib points separated by a slit, said slit having a finite transverse dimension over at least a substantial portion of its length and said nib points being in a noncontacting relationship over at least a substantial portion along the longitudinal length of said slit when said nib is in an unflexed state; and a film of material formed on the surfaces of said nib points perpendicular to and extending over said slit to thereby form two lips which substantially cover said finite transverse dimension of said slit and abut one another when said nib is in an unflexed state.

2. The pen point of claim 1, wherein said film material is chemically inert to said ink and wettable thereby.

3. The pen point of claim 1, wherein said lips extend substantially from the origin of said slit to the tips of said nib points.

4. The pen point of claim 1, wherein said film material is a varnish.

5. The pen point of claim 4, wherein said varnish has a cellulose acetate base.

6. The pen point of claim 4, wherein said varnish has a acetobutyrate base.

7. The pen point of claim 1, wherein said film material is a plastic.

8. The pen point of claim 7, wherein said plastic is chosen from the group consisting of acrylonitrile-butadiene-styrene and a polytetrafluorethylene copolymer.

9. The pen point of claim 8, wherein the wettability of said plastic material has been increased by a surface treatment.

10. The pen point of claim 1, wherein said film material is a metal.

11. The pen point of claim 10, wherein said pen nib is made of a metal which is identical to the metal of said film material.

12. A process for producing a pen point for writing with an ink, comprising the steps of:

coating a pen nib having two nib points separated by a slit, said slit having a finite transverse dimension over at least a substantial portion of its length and said nib points being in a noncontacting relationship over at least a substantial portion along the longitudinal length of said slit when said nib is in an unflexed state, said coating being a continuous film of material chemically inert to said ink and wettable thereby; and dividing said continuous film to thereby form two lips on the surfaces of said nib points perpendicular to and extending over said slit, such that said lips substantially cover said finite transverse dimension of said slit and abut one another when said pen nib is in an unflexed state.

* * * * *